United States Patent [19]

Lamarche

[11] Patent Number: 4,489,227

[45] Date of Patent: Dec. 18, 1984

[54] BACK LIGHTED, FULL TRAVEL PUSH BUTTON MEMBRANE KEYBOARD

[75] Inventor: Fredrick W. Lamarche, Northfield, Minn.

[73] Assignee: Sheldahl, Inc., Northfield, Minn.

[21] Appl. No.: 569,969

[22] Filed: Jan. 11, 1984

[51] Int. Cl.[3] ..... H01H 9/18

[52] U.S. Cl. ..... 200/314; 200/159 B; 200/340; 200/DIG. 47

[58] Field of Search ..... 362/24, 26; 200/5 A, 200/159 B, 302.2, 314, 340, DIG. 47

[56] References Cited

U.S. PATENT DOCUMENTS 3,773,997 11/1973 Evans et al. ..... 200/159 B 4,302,647 11/1981 Kandler et al. ..... 200/159 B 4,362,911 12/1982 Sears et al. ..... 200/159 B

*Primary Examiner*—John W. Shepperd

*Attorney, Agent, or Firm*—Orrin M. Haugen; Thomas J. Nikolai; Douglas L. Tschida

[57] ABSTRACT

A keyboard having a side-lighted transparent support plane including a plurality of light-pipes vertically projecting therefrom through an overlying foam over-travel pad. A pair of patterned membrane switch layers, separated by a low density foam spacer, overly the over-travel pad and are positioned relative to a plurality of key-caps slidably mounted to the light-pipes. The sensation of key travel is achieved via the over-travel pad and/or a foam spring mounted beneath the key-caps with switch contact being made intermediate full key depression. An audible click is achieved via overlapping slidably abrasive projections.

12 Claims, 5 Drawing Figures

BACK LIGHTED, FULL TRAVEL PUSH BUTTON MEMBRANE KEYBOARD

BACKGROUND OF THE INVENTION

The present invention relates to electrical keyboards and, in particular, to a lighted, membrane switch type keyboard operative to provide the operator with the sensation of full travel keys, although manufacturable with a minimum number of pieces.

Electrical switch containing keyboards, such as used in typewriters, calculators, data entry terminals, etc., generally employ relatively large keys with relatively large on-center spacings. These keys are typically rather complex in construction and operate, not only to make switch contact, but to provide an operator with a tactile sensation or feedback, whereby the operator is assured of having made switch contact. Previously, switches have employed a variety of structures ranging from spring loaded assemblies to dome type switch elements to provide this tactile feedback signal. The present invention, however, seeks to provide this tactile feedback in a less complex assembly. In particular, it is an object of the present invention to achieve tactile feedback with a membrane type switch assembly, while providing for back lighted keys.

Prior art switches containing one or more of the features of the present switch can be found upon referring to U.S. Pat. Nos. 3,780,237; 4,304,973; 4,362,911; and 4,370,532. Disclosed in these patents are various switch assemblies that include foam separated membrane switch layers, flange containing switch plungers mountable relative to a key-cap, foam spacers mounted beneath the key-caps and intermediate a membrane switch and a multi-sectioned lighted push button key. Many of the features of the present switch are, therefore, singularly included in these switches. The present invention, however, seeks to combine all of these features in a single, low complexity keyboard of novel construction.

In particular, the keyboard of the present invention utilizes a side-lighted transparent support plane having a plurality of integrally formed light-pipes extending therefrom. Mounted about the light-pipes and overlying the support plane is a foam over-travel pad and above which are mounted one or more patterned membrane switch layers, separated from one another via low density foam spacers. Mounted relative to the patterned switch layers and light pipes are a plurality of key-caps that are slidably operable along the light pipes so as to make switch contact and provide the operator with a tacticle feedback. The caps are contained to the light pipes via flanges and may contain a molded projection interactive with a mating projection on the light pipe for providing the operator with a further "click" like feeling.

The above-mentioned objects, advantages and distinctions of the present keyboard, its construction, as well as various other objects and advantages will become more apparent upon directing attention to the following description thereof with respect to the following drawings. Before referring thereto, though, it is to be recognized that the present description is made with respect to the presently preferred embodiment only and, therefore, various modifications may be made thereto without departing from the spirit and scope hereof.

SUMMARY OF THE INVENTION

A full travel membrane switch having back lighted keys comprising a lighted support plane from which a plurality of integrally formed light-pipes project. Mounted relative to the light-pipes are one or more patterned flexible membrane switch layers separated by a complementary patterned foam spacer and beneath which is mounted a foam over-travel pad. The switch layers are patterned and mounted relative to the light-pipes such that each key-cap is slidably mounted about the light-pipes so as to provide the operator with tactile feedback after having made switch contact.

In an alternative embodiment, foam springs are further included beneath the key-caps. Still further, the key-cap and light pipe may be fabricated to include mating overlapping projections for providing an audible click or increased tactile feedback.

DESCRIPTION OF THE PREFERRED EMBODIMENT

Figure 1:
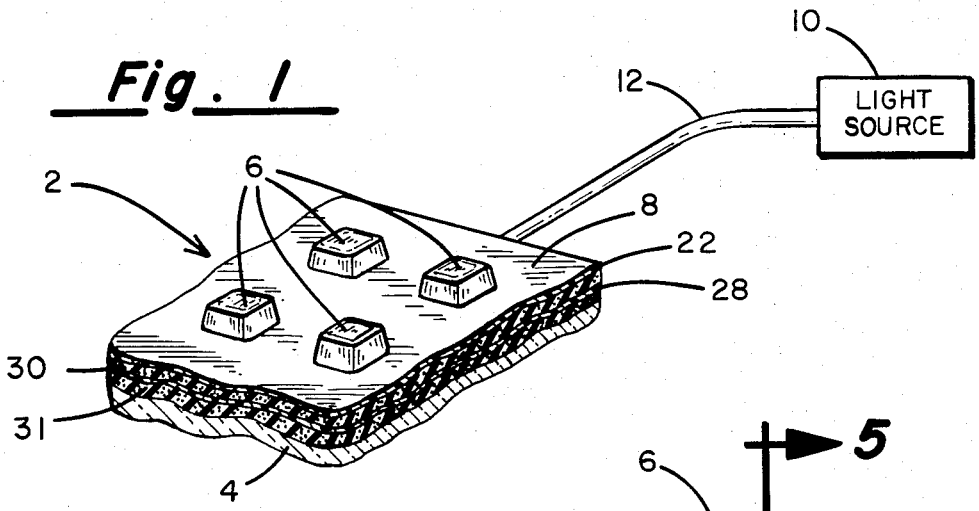
FIG. 1 shows a partial perspective view of a typical keyboard of the present construction.

Referring to FIG. 1, a perspective view is shown of a keyboard 2 constructed in accordance with the present invention. Specifically, the keyboard 2 is constructed of a lower support plane 4 and to which a plurality of back lighted molded key-caps 6 are mounted. Supported above the support plane 4 is a membrane switch 8 and below which a die cut foam over-travel pad 31 is mounted. Further particulars of the construction will, however, be discussed in detail hereinafter.

Generally, though, and during use, the keyboard 2 is typically mounted in an equipment housing having holes formed therein and through which the key-caps 6 mount. A light source 10 is coupled to one or more sides of the support plane 4 so as to generally illuminate the transparent support plane 4 and which acts as a light guide to illuminate the associated light-pipes 14 projecting therefrom beneath the key-caps 6. In the typical construction, the key caps 6 are also light transparent and upon which characters are printed in transparent ink such that the light is conducted from the support plane 4 to the tops of the key-caps 6. While a fiber optic connection 12 is contemplated between the light source 10 and the support plane 4, alternatively, a bulb type light source or the like may be mounted beneath the support plane 4. In either case, though, and upon a support plane 4's guiding the light, the operator is able to visibly observe the back-lighted key characters.

Figure 2:
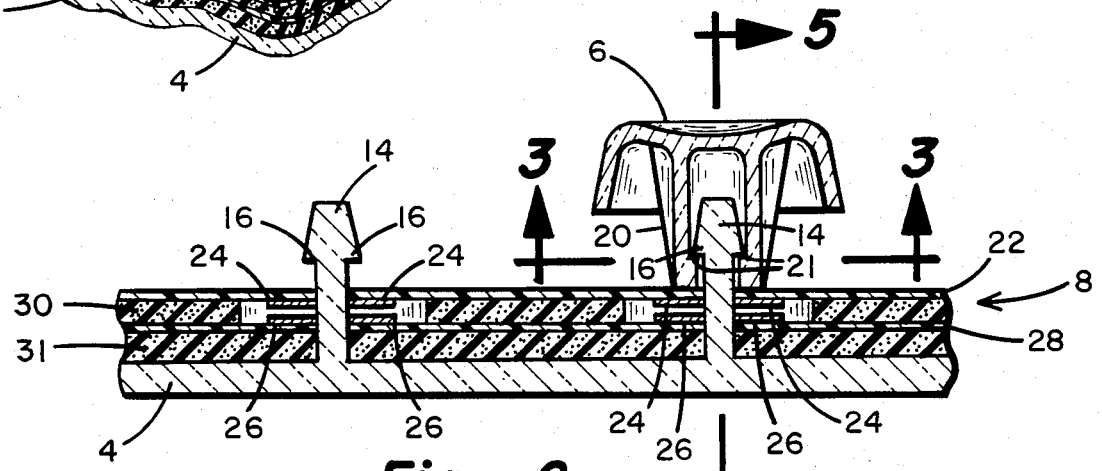
FIG. 2 shows a partial cross-sectional view taken through a typical keyboard of the present construction.
Figure 3:
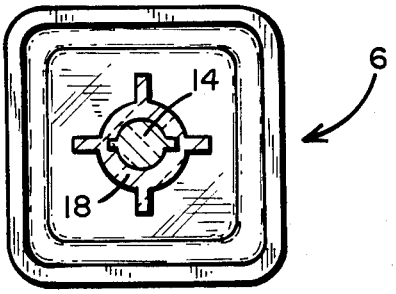
FIG. 3 shows a bottom view of a key-cap mountable about the present flanged light-pipes.

Referring now to FIG. 2, the details of the construction of the present keyboard 2 will be discussed relative to the tactile feedback that is provided via the present full travel keyboard assembly. Specifically, FIG. 2 shows a partial cross-section view taken through a typical one of such keyboards 2 and wherein a plurality of light-pipes 14 project from the lower support plane 4, typically fabricated from an acrylic sheet of approximately 0.1 inch in thickness. Each of the light-pipes 14 is typically cylindrical in shape (although other shapes may be employed) and contains one or more flanges or barbs 16 at its upper end for mating in a nonrotating, contained fashion with its associated key-cap 6. In that regard, attention is further directed to FIG. 3 and wherein a bottom horizontal cross-sectional view (taken along lines 3—3 of FIG. 2) is shown of a typical key-cap 6 and the mating slotted hole 18 that is formed in the cap 6's lower cylindrical standoff 20. The standoff 20 is further formed such that upon placing a key-cap 6 over a light-pipe 14, the flanges 16 pass by an internal ridged region 21 (shown in FIG. 2) so as to permanently contain the cap 6 to the light-pipe 14.

Redirecting attention to FIG. 2, a vertical cross-sectional view is also shown through a typical key-cap 6 relative to its mounting about one of the light-pipes 14. From this view, it is further to be noted that each cap 6's standoff 20 projects below the upper outside edges of the key-cap 6 such that the standoff 20 makes contact with the membrane switch 8 and in particular the lower-lying, upper membrane switch layer 22. Formed on the switch layer 22 is a metallic pattern and which includes a plurality of interconnected contact ring-like patterns 24 that surround each of the light-pipes 14 that pass therethrough. Thus, upon depressing a key-cap 6, the switch layer 22 in the opposed region is depressed so as to bring the upper metallic ring 24 into contact with a lower-lying, mating and similarly formed contact ring 26 contained on the lower-lying membrane switch layer 28. Intermediate the switch layers 22 and 28, in turn, is mounted a complementary patterned low density electrically insulative foam spacer layer 30. The foam spacer 30 is set back of each light pipe 14 and thus acts to separate and maintain each set of switch contacts 24 and 26 in a normally open position, until the key-caps 6 are depressed.

Mounted beneath the membrane switch layer 28 is a foam over-travel pad 31 that provides the tacticle feedback to the operator after the switch contacts 24 and 26 have been brought together and upon the further depression of a key-cap 6. Depending upon the density and thickness of the foam over-travel pad 31, the amount of tactile feedback may be adjustably varied. For the presently preferred embodiment, it is contemplated that an over-travel pad 31 of a density in the range of 60 to 70 I.L.D. (where I.L.D. is Indentation Load Deflection, or stated differently the force required to compress a 4-inch thick by 7-inch diameter disc of foam 2 inches) and a thickness in the range of 0.090 to 0.120 inch and a foam spacer 30 of a density in the range of 35 to 40 I.L.D. and a thickness of 0.030 to 0.060 inch would provide sufficient tactile feedback to the operator. It is to be recognized, however, that depending upon the relative thickness and densities, the amount of feedback may be tailored for any given keyboard 2.

Figure 4:
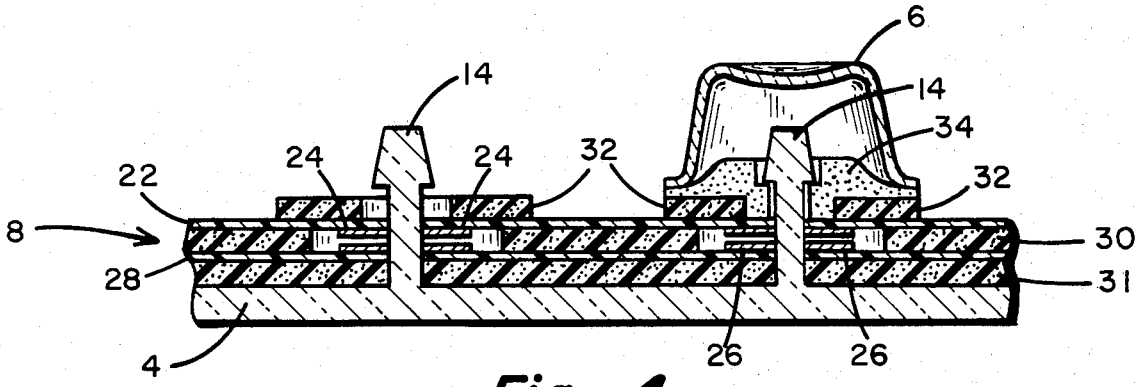
FIG. 4 shows a partial cross-sectional view through a keyboard of alternative construction and wherein foam springs are provided beneath the key-caps.

Referring now to FIG. 4, a cross-sectional view is shown of an alternative keyboard of the type of FIG. 2, but wherein a die cut foam spring 32 is inserted beneath each of the key-caps 6. In this embodiment, the key-caps 6 are fabricated in a vacuum forming operation and include a separately mounted button guide 34 that is formed and operative in a fashion similar to the standoff 20 of FIG. 2. Comparing the embodiments of FIGS. 2 and 4, therefore, it is to be noted that for FIG. 2, the light-pipes 14 tend to be mounted rather loosely within the key-caps 6, such that the standoff 20 is supported by the membrane switch layer 22. However, for FIG. 4, the foam spring 32 supports each key-cap 6 and prevents against too loose of a fit. Further, by adjusting the densities and thicknesses of the foam spring 32 and the over-travel pad 31, similar tactile feedback sensations can be achieved.

Figure 5:
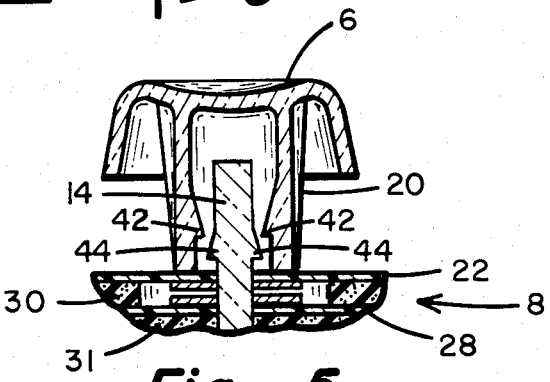
FIG. 5 shows a cross-sectional view taken through a key-cap wherein an audible or increased tactile feedback is provided.

Directing attention now to FIG. 5 (which would equate with a view taken along lines 5—5 of FIG. 3, although the feature to be described is not part of FIG. 3) and recognizing that it may be desirous in some keyboards 2 to provide the operator with an audible or tactile "click"-like feedback, one or more pairs of overlapping projections 42 and 44 may be formed at 90° to the flanges 16 on the inside surface of standoff 20 and the mating surface of the light pipes 14 so as to interact with one another upon depressing the key-caps 6. Depending upon the amount of interaction and/or the number of projections 40 and 42, a click of varying magnitude will result. Thus, switch closure in this instance is indicated to the operator in two forms, that is, via key over-travel and via a sensed click. It is to be recognized, too, that the projections 40 and 42 may be combined with either of the keyboard embodiments of FIGS. 2 and 4, that is, with or without the foam springs 32.

From the above, it should further be apparent that the present keyboards 2 are easily fabricated with a minimum number of steps. Principally, the steps of a typical fabrication procedure would comprise a molding of the support plane 4; the patterned deposition of metal onto the switch layers 22 and 28; the die cutting of the low density foam support material; the adhesive bonding of the switch layers 22 and 28 to the foam spacer 30; the "cookie cutting" of discrete key locations into the over-travel pad; and finally, the stacking of the successive layers onto the support plane 4 and the mounting of the individual key-caps 6 onto the light-pipes 14.

While the present invention has been described with respect to a number of alternative embodiments, it is to be recognized that still further modifications may be made thereto without departing from the spirit and scope of the invention. It is, accordingly, contemplated that the following claims should be interpreted so as to include all those equivalent embodiments within the spirit and scope thereof.

What is claimed is:

1. An electrical switch array comprising:

(a) a support plane having a plurality of integrally formed projections extending from at least one surface thereof;

(b) resilient support means overlying the surfaces of said support plane from which said projections extend and through which said projections pass;

(c) membrane switch means overlying said resilient support means and having at least two flexible dielectric planar sheets, each separated from one another via an electrically insulative spacer, and wherein each of said dielectric sheets includes a plurality of patterned electrical contacts, said membrane switch means further including a plurality of apertures formed therethrough in the regions of said electrical contacts for mounting over said projections; and (d) key-cap means mounted over each of said projections and slidably operative relative thereto for depressibly bringing lower lying ones of the contacts on at least one of said flexible membrane sheets in the region of each depressed key-cap into electrical contact with the contacts on at least one other of said flexible sheets.

2. An array as set forth in claim 1 including a light source and means for mounting said light source to said support plane and wherein said support plane guides the light to and through each of said projections so as to back-light an operator exposed surface on each of said key-caps.

3. An array as set forth in claim 1 wherein each of said key-caps includes at least one first projection extending from an inside surface thereof, each of said first projections overlapping in the path of travel with a plurality of second projections extending from said support plane projections, the frictional interaction of said first and second projections audibly indicating the closure of said switch contacts.

4. A switch array as set forth in claim 1 wherein each of said support plane projections includes one or more barbs projecting therefrom and mountable relative to a mating slot formed in said key-caps for nonrotatively, containably securing said key-caps to said support plane projections in slidable relation.

5. A switch array as set forth in claim 4 including a foam spring mounted beneath each of said key-caps for resiliently supporting each of said key-caps.

6. An electrical switch array comprising in combination:

(a) a light transparent support plane having a plurality of integrally formed projections extending from at least one surface thereof;

(b) a light source coupled to said support plane for transmitting light through the tops of said projections;

(c) a resilient support pad overlying each of said surfaces from which said projections extend and through which said projections pass;

(d) first and second flexible switch layers, each having a plurality of patterned electrically conductive switch contacts deposited thereon in the region of a plurality of apertures formed therethrough and corresponding to the location of said support plane projections;

(e) a resilient support layer mounted between said first and second switch layers having a plurality of apertures formed therethrough relative to said support plane projections; and (f) a plurality of key-caps nonrotatively contained and slidably mounted to said support plane projections, whereby upon depressing each of said key-caps, said first and second switch layers may be brought into electrical contact in a region localized to said key-cap.

7. A switch array as set forth in the claim 6 wherein said patterned electrical contacts comprise an annular ring.

8. A switch array as set forth in claim 6 including a plurality of resilient foam springs mounted beneath each of said key-caps.

9. An array as set forth in claim 6 wherein each of said support plane projections include one or more integrally formed flanges extending therefrom for mounting within a mating slot formed in said key-cap, thereby nonrotatively containing said key-cap to said support plane projection.

10. Apparatus as set forth in claim 6 including means operatively coupled to said support plane projection and said key-caps for audibly indicating switch closure.

11. An electrical switch array comprising:

(a) a light guiding support plane having a plurality of integrally formed projections extending from at least one surface thereof;

(b) a light source mounted to said support plane such that said support plane guides the light to the top of each of said projections;

(c) resilient support means overlying the surfaces of said support plane from which said projections extend and having a plurality of apertures through which ones of said projections pass;

(d) membrane switch means overlying said resilient support means and having at least two flexible dielectric planar sheets, each separated from one another via an electrically insulative spacer and wherein each of said dielectric sheets includes a plurality of patterned electrical contacts, said membrane switch means further including a plurality of apertures formed therethrough in the regions of said electrical contacts for mounting over said projections;

(e) key-cap means nonrotatively mounted over each of said projections and slidably operative relative thereto for depressibly bringing lower lying ones of the contacts on at least one of said flexible membrane sheets in the region of each depressed key-cap into electrical contact with the contacts on at least another one of said flexible sheets;

(f) a foam spring mounted beneath each of said key-caps for resiliently supporting each of said key-caps away from said membrane switch means; and (g) means frictionally engaging each of said key-caps as it is depressed for audibly indicating the closure of said switch contacts.

12. An array as set forth in claim 11 wherein said audible means comprises at least one first projection extending from an inside surface of each of said key caps each of said first projections overlapping in the path of travel with a plurality of second projections extending from said support plane projections, such that the frictional interaction between said first and second projections audibly indicates the closure of said switch contacts.

* * * * *